United States Patent [19]

Redman

[11] 4,376,359

[45] Mar. 15, 1983

[54] FASTENER CLIP FOR GLAZED DOORS

[75] Inventor: Ronald E. Redman, Niles, Mich.

[73] Assignee: Kawneer Company, Inc., Niles, Mich.

[21] Appl. No.: 211,512

[22] Filed: Dec. 1, 1980

[51] Int. Cl.[3] ..... E06B 3/62

[52] U.S. Cl. ..... 52/127; 52/397; 52/769

[58] Field of Search ..... 52/764, 766, 768, 769, 52/770, 397, 398, 718, 127; 24/292, 293, 294, 295, 296

[56] References Cited

U.S. PATENT DOCUMENTS

| | | | |
|---|---|---|---|
| 2,330,675 | 9/1943 | Brown | 52/718 |
| 2,754,561 | 7/1956 | Bedford | 52/718 |
| 2,971,229 | 2/1961 | May | 52/769 |
| 3,123,869 | 5/1964 | May | 52/397 |
| 3,157,918 | 11/1964 | Adams | 52/769 |
| 3,242,543 | 3/1966 | Adams | 52/718 |

FOREIGN PATENT DOCUMENTS

| | | | |
|---|---|---|---|
| 6617475 | 9/1967 | Netherlands | 52/769 |

*Primary Examiner*—John E. Murtagh

*Attorney, Agent, or Firm*—Mason, Kolehmainen, Rathburn & Wyss

[57] ABSTRACT

A fastener for glazed doors of the type including a glazing panel and a frame having a channel-shaped surface extending along an edge of the panel and having a web normal to a panel face and a pair of opposite flanges. The fastener includes a thin sheet metal base adapted to be mounted on the web of the frame member and having wedge arms engageable against the opposite flanges of the frame member when the body of the fastener is rotated about an axis normal to the web with a tool or other implement to securely retain the fastener in place. The fastener includes one or more fingers having a free outer end extending outwardly toward an adjacent flange of the frame member and spaced from the web in order to form a slot for receiving an inside edge of glazing strip which is positioned between the finger and the adjacent flange. The fasteners can be rapidly installed on the frame members with only a screw driver and do not require any hole drilling or punching operations or the use of any separate screws, rivets, or clips.

23 Claims, 7 Drawing Figures

FIG. 1
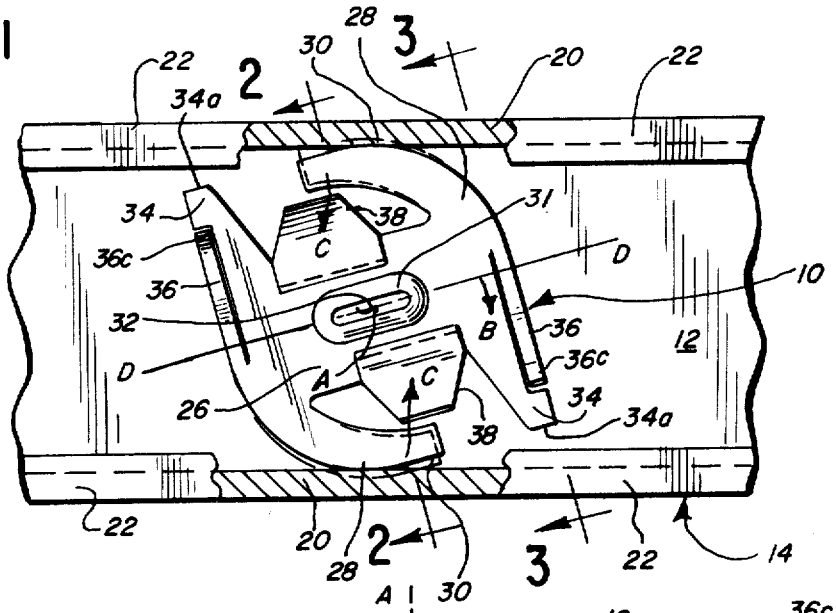
FIG. 2
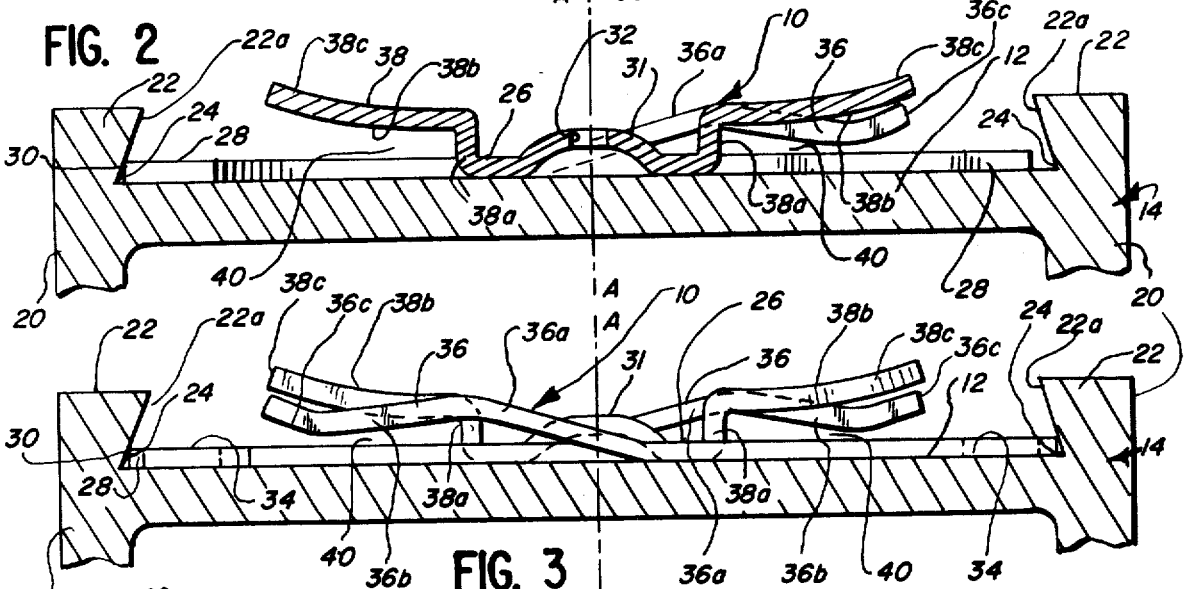
FIG. 3
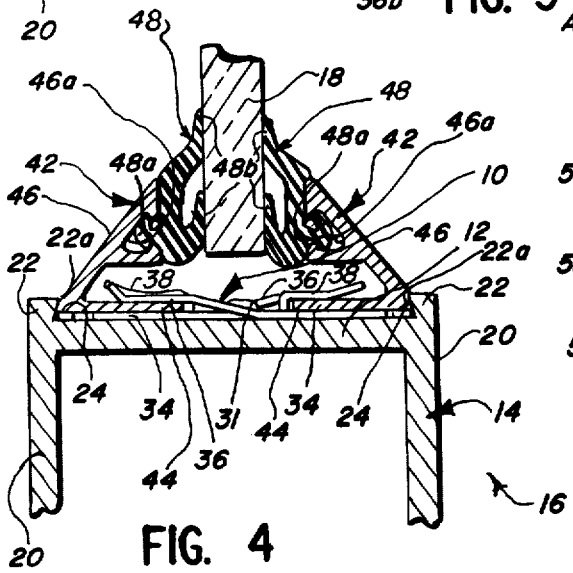
FIG. 4
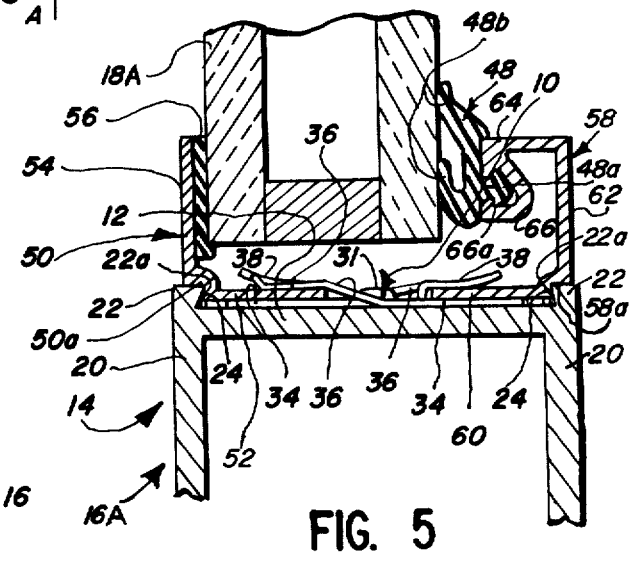
FIG. 5

FASTENER CLIP FOR GLAZED DOORS

BACKGROUND OF THE INVENTION

1. Field of the Invention

The present invention relates to fasteners for glazed doors and more particularly, relates to a novel glazing fastener which may be rapidly installed on a metal door frame without screws or rivets for supporting glazing strips used for trimming around the edges of a glazing panel in the frame.

2. Description of the Prior Art

Glazed metal doors suitable for duty in commercial establishments and employing hollow tubular stiles and rails of extruded aluminum, are shown in U.S. Pat. No. Re. 28,639; U.S. Pat. No. 4,225,163; U.S. Pat. No. 4,009,537; U.S. Pat. No. 3,938,282; U.S. Pat. No. 3,888,046; U.S. Pat. No. 3,903,647; U.S. Pat. No. 3,844,084; U.S. Pat. No. 3,816,011; and in U.S. copending patent application Ser. No. 180,624, filed Aug. 25, 1980. In the above-mentioned patents, a variety of different means have been utilized for securing glazing strips in place within large rectangular opening(s) of a metal door frame, and the aforementioned copending patent application illustrates a system for securing glazing strips in place by employing a plurality of pie-pan shaped disk elements which are secured on the inwardly facing webs of the tubular rails and stiles by means of separate screw fasteners.

OBJECTS OF THE INVENTION

It is an object of the present invention to provide a new and improved fastener for glazing doors.

More particularly, it is an object of the present invention to provide a new and improved door glazing fastener which does not require the use of additional screw type or rivet type fasteners and which does not require the drilling or punching of holes in the door frame members.

Still another object of the present invention is to provide a new and improved door glazing fastener of the character described which can be rapidly installed on a door frame member with a simple tool such as a screw driver and which is then capable of securely holding a glazing strip in place on the frame member adjacent the glazing panel.

Another object of the present invention is to provide a new and improved door glazing fastener of the character described which is adapted to be rapidly and securely positioned on a frame member with a single twist of a tool such as a screw driver with a stop engagement to prevent further rotation.

Yet another object of the present invention is to provide a new and improved door glazing fastener or clip which eliminates the need for drilling or punching holes in the door frame members and which eliminates the need for any separate screw fasteners or rivets for attaching the same onto the door frame members.

Still another object of the present invention is to provide a new and improved glazing fastener for metal doors and the like wherein presently available types of glazing strips can be accommodated without special adaptation or modification.

Still another object of the present invention is to provide a new and improved door glazing fastener of the character described wherein a pair of deflectable wedging arms are utilized to provide wedging and secure holding action to firmly position the fastener between flanges of the door frame member.

Still another object of the present invention is to provide a new and improved glazed metal door employing novel fasteners of the character described for securing glazing strips in place.

Another object of the present invention is to provide a new and improved door of the character described wherein faces of the glazing panel are flanked by pairs of interlocking glazing strips one of which strips is secured to the door frame member by a novel fastener of the character described herein.

Yet another object of the present invention is to provide a new and improved door glazing fastener of the character described which is suitable for use with a variety of different types of glazing strips or elements and which can be utilized to accommodate single thickness glass panes or panels as well as dual thickness insulating type glass panels or the like.

Yet another object of the present invention is to provide a new and improved door glazing fastener of the character described which may be fabricated in a punch press type operation from thin sheet metal shock.

Still another object of the present invention is to provide a new and improved door glazing fastener of the character described which is fully compatible with existing types of metal door frames that are available.

Yet another object of the present invention is to provide a new and improved door glazing fastener of the character described which is readily adapted to facilitate rapid reglazing of the door should a door panel become broken or need replacement.

Another object of the present invention is to provide a new and improved door glazing fastener of the character described which is of a unitary construction struck from thin sheet metal stock, which is economical to produce and which is easily installed on a door frame by relatively unskilled labor.

Another object of the invention is to provide a new and improved door glazing system wherein a marginal edge of a door glazing panel is trimmed by a pair of interlocking glazing strips, one of metal and one of flexible resilient material.

BRIEF SUMMARY OF THE INVENTION

The foregoing and other objects and advantages of the present invention are accomplished by a new and improved door glazing fastener used for attaching one or more glazing strips along a web of a frame member extending along a peripheral edge of a glazing panel in a metal door frame. The door includes frame members of the type having a web normal to the glazing panel and a pair of ribs along opposite edges of the web forming a pair of opposed recesses on opposite sides of the panel faces. A novel fastener in accordance with the invention comprises a body of thin sheet material including a pair of integrally formed wedging arms on opposite edges having free outer end portions which are adapted to be wedged into the opposite recesses of the frame member for securing the fastener in place on the web between the ribs. A slot is provided in a central portion of the fastener body between the arms and is adapted to receive a tool such as a screw driver blade which is inserted therein and turned to rotate the fastener body about an axis normal to the web into a holding position wherein end portions of the wedging arms are forcefully wedged into tight engagement with opposed ribs of the frame member. The arms are deflected inwardly toward the central portion of the fastener body when wedged in place and thereby provide a positive holding force securing the fastener to the frame. At least one finger is integrally formed on the body of the fastener for engaging and retaining an inner edge portion of a glazing strip(s) which is positioned between the adjacent rib on the door frame member and the finger. The fasteners may be rapidly installed on the web of a metal door frame without requiring any holes to be drilled or punched and without requiring the use of separate screw fasteners, rivets or other separate fastening elements.

BRIEF DESCRIPTION OF THE DRAWINGS

For a better understanding of the present invention reference should be had to the following detailed description taken in conjunction with the drawings, in which:

FIG. 1 is a plan view of a new and improved door glazing fastener in accordance with the features of the invention mounted in an unwedged position on the web of a door frame member;

FIG. 2 is an enlarged transverse, cross-sectional view taken substantially along line 2—2 of FIG. 1;

FIG. 3 is an enlarged transverse, cross-sectional view taken substantially along lines 3—3 of FIG. 1;

FIG. 4 is an enlarged transverse, cross-sectional view similar to FIGS. 2 and 3 and illustrating a portion of a completed door of the type glazed with a single thickness glazing panel;

FIG. 5 is a transverse, cross-sectional view similar to FIG. 4 but, illustrating a door having a dual pane type insulating glazing panel installed therein.

DESCRIPTION OF PREFERRED EMBODIMENTS OF THE INVENTION

Figure 6:
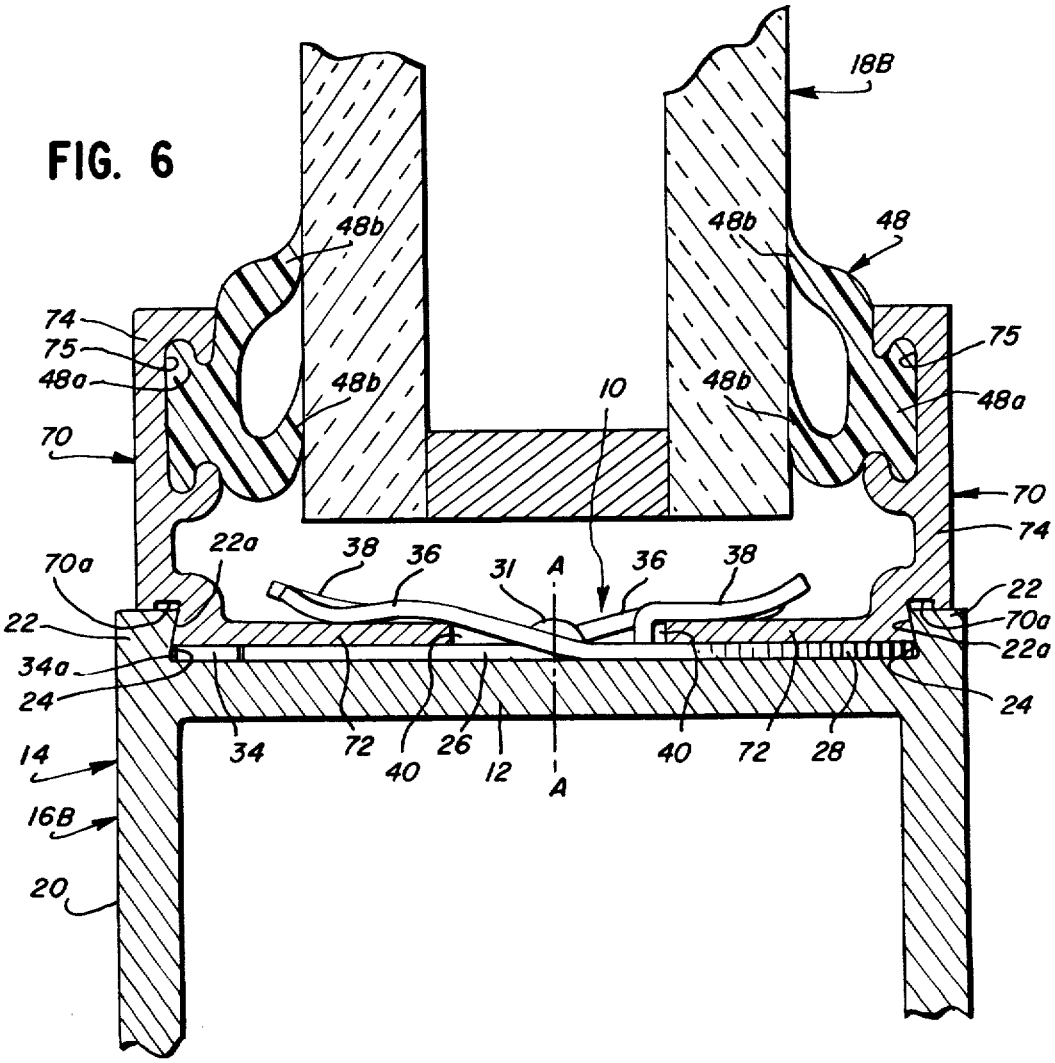
FIG. 6 is an enlarged, transverse, cross-sectional view illustrating another door having an insulating glass panel.

Referring now more particularly to the drawings, therein is illustrated a new and improved door glazing fastener constructed in accordance with the features of the present invention and referred to generally by the reference numeral 10. In accordance with the invention, the fastener 10 is adapted to be rapidly installed at desired spacing intervals on a web 12 of an elongated, hollow tubular frame member such as a rail or stile 14 of a glazed door 16, 16A or 16B (FIGS. 4, 5 and 6). The rails and stile are interconnected at upper and lower corners (not shown) to form a generally rectangular, metal door frame, and as shown in the aforementioned prior art patents, the corner ends of the rails and stiles may be interconnected together in a variety of different manners as illustrated to form the completed frame ready to receive one or more glazing panels.

The generally rectangular, glazing openings of a door frame are adapted to receive a glazing panel such as a single thickness glass pane 18 (FIG. 4) or a double thickness, insulating type glass panel 18A or 18B (FIGS. 5 and 6) and these panels are installed and secured in place with elongated glazing strips around the edges. As illustrated in FIGS. 4, 5 and 6, opposite faces of the respective glazing panels 18, 18A and 18B are spaced between opposite wall faces 20 of the tubular rails and stiles 14 and the web 12 lies on a plane generally normal or perpendicular to the panel edge faces and spaced outwardly thereof.

The tubular stiles and rails are formed with a pair of longitudinally extending ribs 22 of generally trapezoidal-shaped transverse cross-section as shown best in FIGS. 2, 3 and 6 and these ribs have a common outer wall surface that is even with the wall faces 20 of the tubular members. The ribs 22 extend above the surface of the webs 12 and form a channel-shaped transverse cross-section on the frame member directly facing an edge of a glazing panel 18, 18A or 18B. Inside wall surfaces **22*a* of the ribs slope downwardly and outwardly with respect to the surface of the web 12 thereby forming a pair of opposed, concave recesses 24** which flank the opposite faces of a glazing panel.

In accordance with the present invention, the glazing fastener 10 is adapted to be installed and secured in place on the web 12 of the tubular stiles and rails at appropriate spaced apart intervals thereon with only a simple screw driver or equivalent and without requiring any holes to be drilled or punched in the web 12 and without the need for any other separate screw or rivet type fasteners.

The fastener 10 is adapted to be struck in a punch press type operation from sheet stock of thin, tough sheet metal such as stainless steel or the like and is uniquely shaped and designed, as will be described hereinafter, to permit rapid installation on a door frame and to provide an extremely efficient glazing system for a glazed metal door.

The fastener includes a generally rectangularly shaped central body portion 26 having a pair of curved outer wedging arms 28 integrally formed at diagonally opposite corners on the body. Each arm has an arcuately curved outer edge surface 30 forming the edge of a free outer end portion which is adapted to seat in wedging engagement within a recess 24 of an adjacent rib 22 on the frame member 14 when the body portion 26 of the fastener 10 is rotated about an axis A—A (FIGS. 2, 3 and 6) extending through the center thereof and generally normal to the web 12 as illustrated.

Figure 1A:
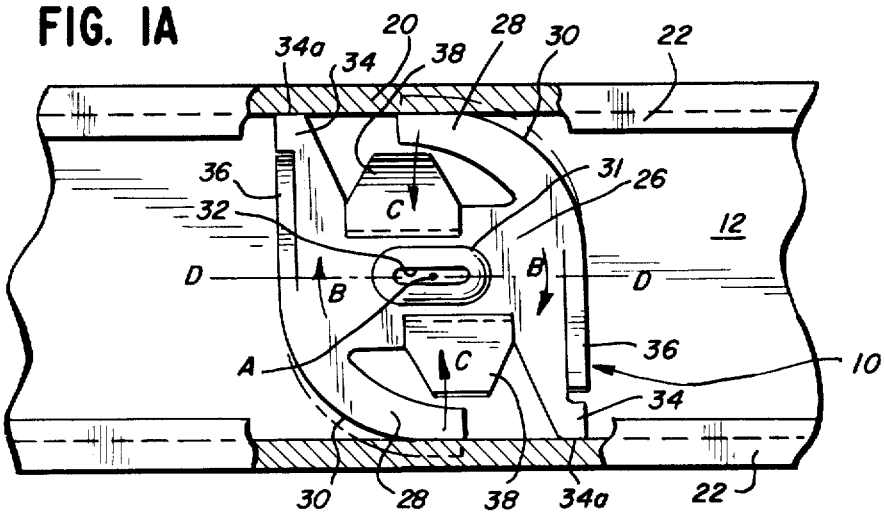
FIG. 1A is a plan view similar to FIG. 1 showing the fastener in a fully wedged holding position on the web of a door frame member.

In order to facilitate rotation of a fastener after placement on the web 12 to wedge the arms into holding engagement as shown in FIG. 1A against the inside surfaces **22*a* of the ribs at opposite points on the spaced apart ribs 22 of the tubular frame member, the central portion 26 is formed with a race track-shaped raised embossment 31 having an elongated slot 32 therein adapted to receive the blade or end of a screw driver or other tool. The tool is temporarily inserted in the slot to apply rotational movement to force the arms 28 tightly against the sloped walls 22*a* and web 12 of the recesses 24** on opposite sides of tubular frame member.

When the wedging action is accomplished and sufficient force or torque is applied in a clockwise direction (as shown in FIGS. 1 and 1A by the curved arrow "B"), the outer end portions and outer edges 30 of the curved arms 28 are deflected slightly inwardly in the direction of the arrows "C". This deflection is obtained as the tangential frictional engagement between the outer edge surfaces 30 and the sloped rib surfaces **22*a* is increased. The deflection is indicated in exaggerated form by the dotted lines in FIGS. 1 and 1A which illustrate the arms in an undeflected condition and by the solid outline in a secured or holding position wherein the deflected arms are in wedged holding engagement to securely hold the fastener 10 in place with the central body portion 26 biased against the surface of the web 12**.

Additional clockwise rotation past the secured or holding position of FIG. 1A is limited by engagement of outer stop surfaces 34a on the ends of a pair of tapered legs 34 on opposite sides of the fastener between the inner ends of the wedging arms 28. Outer edges of the legs 34 are normal to an axis D—D along the longitudinal axis of the slot 32 and the stop surfaces 34a are normal thereto. Because the frictional wedging engagement between the curved outer edges 30 of the curved holding arms 28 is generally tangentially aligned against the inner surfaces 22a of the respective ribs 22, the body 26 of the fastener 10 is tightly wedged against the surface of the web 12 as illustrated and cannot readily be displaced either in a longitudinal, lateral or upward direction. When the fastener 10 is rotated into the holding position of FIG. 1A it remains permanently in place but may be removed by inserting the blade of a screw driver into the slot 32 and applying sufficient force for rotating the fastener about the axis A—A in a counterclockwise direction until the outer edge surfaces 30 of the arms move out of contacting engagement with the sloped wall surfaces 22a of the ribs 22. The fastener may be further rotated until the edges of the legs 34 are positioned between and parallel of the opposite ribs 22, and the fastener may then be picked up and removed from the shallow, channel-shaped recess of a tubular frame member 14.

The fastener 10 is dimensioned so that the maximum distance between the tips of the outer edges 30 of the arms 28 (when not deflected and as measured in a direction aligned with the section lines 2—2 in FIG. 1) is slightly greater than the maximum transverse spacing between the apexes or corners of the opposed recesses 24 of the tubular frame member 14. Thus, when the fastener is rotated in a clockwise direction about the axis "A" with a screw driver blade in the slot 32, the arms 28 are deflected slightly inwardly and this deflection provides a positive and permanent holding wedged engagement to secure the fastener in a chosen position between the ribs 22. The body 26 of the fastener 10 has a transverse dimension measured along an axis "D—D" (FIGS. 1 and 1A) aligned longitudinally with the slot 32 that is less than the farthest spacing or maximum dimension between the outer edges 30 of the curved arms.

The generally rectangular fastener body, the tapered stops or legs 34 and the curved wedging arms 28 lie in a common plane against the web 12. Outer edges of each leg 34 are cut or slit to form a thin holding finger 36 which is struck from the body of the fastener leg and as best shown in FIG. 3, each finger includes an inner segment 36a sloping upwardly of the body 26. An outer end of the inner finger segment joins an outwardly and downwardly sloping intermediate segment 36b and the intermediate segment is joined with an outwardly and upwardly sloping, relatively short, terminal end segment 36c having a free outer end spaced upwardly above the outer end portion of the leg 34 from which the finger is struck.

The thin fingers 36 are deflectable toward and away from the plane of the central fastener body 26 and serve to resiliently bias an inner edge portion of a glazing strip toward the web 12 as shown in FIGS. 4, 5 and 6.

In addition to these holding fingers 36, the fastener 10 also includes a pair of somewhat larger, trapezoidal-shaped wider and stronger fingers 38 that are positioned closer to the center of the body 26 and are spaced on opposite sides of the race track-shaped embossment 31. These inner retaining fingers include upstanding segments 38a generally normal to the body 26 and are struck therefrom as best shown in FIG. 2. The upstanding segment 38a of each finger is joined at an upper end to an outwardly extending intermediate segment 38b with an upsloping outer end segment 38c at the free outer end or tip.

The fastener 10 includes at least one inner finger 38 and a parallel outer finger 36 on each side of the axis line "D—D" extending toward an adjacent rib 22. The undersurface of each finger on the one hand and the upper surface of the body 26, the curved arms 28, and the legs 34 on the other hand cooperate to form outwardly open-ended slots 40 for receiving and holding an elongated inner edge portion on the base of a glazing strip as illustrated in FIGS. 4, 5 and 6. The outer end portions of the fingers are sloped upwardly away from the web 12 to facilitate insertion of an inner edge of the base of a glazing strip. The downward slope of the intermediate sections of the thin fingers 36 tends to bias and maintain a continuing downward pressure on the glazing strip base to hold the same in place even on a temporary basis, as for example when a door frame is shipped with the glazing strips in place but without the glazing panels which will be installed later on or at the installation site. The outer end segments 36c and 38c of the respective fingers act as camming guides to direct the inner edge portion of a base segment of a glazing strip into the slots 40. Thereafter, the fingers 36 and 38 function to hold and retain glazing strips in place within the channel-shaped recess of a tubular door frame member 14A, and the stronger fingers serve to resist wind loads applied to the glazing panels.

Referring now to FIG. 4, the door 16 therein illustrated employs a pair of outer, metal, elongated glazing strips 42 flanked on opposite sides of the panel faces of the single thickness glazing panel 18. Each metal glazing strip 42 includes a base 44 having an inner edge portion extended into the slots 40 formed by the deflectable fingers 36 and 38 of the fasteners 10. The base of the strip rests on the upper surface of the legs 34, the central base 26, and the curved arms 28 of the fasteners 10 that are mounted on the webs 12. The glazing strip is formed with an upwardly and inwardly sloping leg 46 having a thickened portion adjacent the inside of the upper edge. This portion has a generally acute-angular-shaped, transverse cross-section with a continuous longitudinal slot or groove 46a formed therein in order to receive the tongue 48a of a second, flexible resilient sealing glazing strip 48.

An outer metal glazing strip 42 is installed on the frame member 14 with the base 44 wedged into place with the inner edge portion inserted into the slots 40 formed by the deflectable holding fingers 36 and 38 of the fasteners 10. The outer, corner edge of the strip 42 at the junction between the base 44 and the upwardly and inwardly sloping leg 46 is curved and fits tightly against the sloped, inside surface 22a of the rib 22 to provide wedging engagement to retain the glazing strip in place. The strip can be removed by prying upwardly on the outer corner with a tool having a thin blade such as a screw driver. This action deflects the thin fingers 36 upwardly so that the outer edge of the base 44 of the metal glazing strip is elevated above the rib 22 and is free of the recess 24 of the frame member.

The resilient sealing strips 48 are formed of weather resistant, molded plastic material having suitable flexure characteristics so that the strip may be secured in place with the tongue 48a thereof interlocked into the groove 46a of the metal glazing strip 42. Each resilient glazing strip 48 includes a pair of flexible sealing lips 48b on the inside and spaced apart with a free outer edge portion adapted to bear and seal tightly against the adjacent panel face of the glazing panel 18.

In glazing or reglazing a door 16, after the fasteners 10 are in place as described, a first metal glazing strip 42 and an attached resilient sealing strip 48 is mounted on each frame member on one side of the door. The glazing panel(s) 18 is set in place, and then the metal glazing strips 42 with sealing strips 48 mounted thereon are snapped into place on the opposite side of the door to complete the glazing process.

Referring to FIG. 5, when a dual pane insulating panel 18A is installed as illustrated in a door 16A, different types of glazing strips may be utilized with the same fasteners 10 in order to accommodate the increased thickness of the insulating glass. On the left hand side as viewed in FIG. 5, an angle-type metal glazing strip 50 is provided having a lower base 52 with an inner edge portion extended into the slots 40 between the fingers 36 and 38 and the body of the installed fasteners 10. The angle glazing strip is formed of metal and includes an upstanding leg 54 with a flat, resilient sealing strip 56 mounts thereon and interposed between the upstanding leg and the adjacent face of the insulating glazing panel 18A. At the junction of the base leg 52 and the upstanding leg 54, the glazing strip 50 is formed with a groove 50a on the outer corner to match the shape of the rib 22 of the tubular frame member 14.

To install the strip 50, the base is snap-fitted and wedged between the rib 22 and the slots 40 provided by the fingers 36 and 38 of the fasteners 10. After the angle glazing strip 50 is installed and the glazing panel(s) 18A is positioned in place as shown, a second, channel-shaped glazing strip 58 is installed adjacent the edges on the opposite face of the insulating panel. The glazing strip 58 includes a lower base 60, an upstanding web 62, and an inwardly directed flange 64 having an enlarged, relatively thick, depending rib portion 66 adjacent the edge. The rib 66 has a groove 66a on the inside face for receiving the tongue 48a of a resilient sealing strip 48 like the strip utilized in the embodiment shown in FIG. 4. At the corner junction between the web 62 and base 60 of the channel-shaped glazing strip 58, there is formed a groove 58a having a cross-section matched to that of the rib 22 in the tubular frame member 14 so that the channel-shaped strip can be snapped into wedging engagement as illustrated. The glazing strip 58 and a resilient sealing strip 48 are installed into place to finish the glazing process.

Referring to FIG. 6, another embodiment of a glazed door 16B employing an insulating type glazing panel 18B and tubular frame members 14 is illustrated. Angle-type glazing strips 70 are utilized on both sides of the door in conjunction with resilient sealing strips 48 similar to those of the other doors shown in FIGS. 4 and 5. The modified metal glazing strips include a base leg 72 engaged in the slots 40 of the fastener 10 and an upstanding leg 74 having a groove 75 on the upper portion of the inside face for receiving the tongue 48a of a resilient sealing strip 48. A groove 70a is formed at the corner of the legs 72 and 74 to accommodate the ribs 22 of the frame member when the glazing strips are snapped into place.

From the foregoing it will be seen that the new and improved fasteners 10 constructed in accordance with the features of the present invention may be rapidly and easily installed on the web of the tubular door frame members thereby greatly facilitating and speeding up the glazing process in a glazed metal door. The fasteners 10 are useful with a variety of different types of glazing strips as illustrated in FIGS. 4, 5 and 6 and are useful in accommodating a variety of thicknesses of glazing panels such as the panels 18, 18A and 18B. Moreover, the fasteners 10 eliminate the need for drilling or punching holes in the frame members of the door and do not require the use of additional screw or rivet type fasteners.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent is:

1. A fastener clip for securing one or more glazing strips in position along a web of a frame member extending along a peripheral edge of a glazing panel flanked by said strips, said web including a substantially planar base surface generally normal to a face of said glazing panel and a pair of upstanding ribs engaged by said glazing strips when positioned to glaze said panel and extending along opposite edges of said base surface, said base surface and said ribs forming a pair of opposed recesses extending longitudinally of said frame member along opposite sides, each of said recesses adapted to receive and hold a corner portion of a glazing strip engaged therewith; said fastener clip comprising:

a unitary body of thin sheet material including a pair of integral wedging arms on opposite sides of a central portion of said body, said arms having free outer end portions adapted to extend into said opposed recesses of said frame member for securing said fastener clip in place on said web between said ribs without other fasteners;

slot means defined in said central portion of said body between said pair of arms adapted for receiving a tool removably engageable to rotate said body about an axis normal to said web from a first position when said free outer end portions of said arms are clear of said ribs toward a second secured position wherein said end portions are forcefully engaged against opposite facing inside faces of said ribs and said base surface, and are deflected inwardly toward said central body portion by said forceful engagement for tightly securing said fastener clip in place on said web; and integral holding means struck from said body including a pair of fingers between said wedging arms for engaging an inner edge portion of a glazing strip to retain said strip in position engaging a rib along said frame member.

2. The fastener clip of claim 1 wherein said wedging arms include outer edges for tangential engaging contact against said inside faces of said ribs.

3. The fastener clip of claim 2 wherein said outer edges of said wedging arms are deflectable inwardly as said body is rotated in one direction about said axis to increase frictional holding contact between said outer edges and the inside face of said ribs and said base surface of said web.

4. The fastener clip of claim 3 wherein said outer edges tend to deflect outwardly of said central portion upon rotation of said body in an opposite direction toward said first position.

5. The fastener clip of claims 1, 2, 3 or 4 in combination with said frame member wherein said inside faces of said ribs slope downwardly and outwardly toward said base surface for camming engagement with said outer end portions of said wedging arms to bias the same toward said base surface when said body is rotated about said axis toward said second position.

6. The fastener clip of claim 1 wherein said fingers extend outwardly of said central portion of said body toward said ribs when said clip is in said second position, each finger having a free outer end portion deflectable toward and away from said base surface of said frame member to hold an inner edge portion of a glazing strip inserted between said finger and said base surface when said glazing strip is positioned with a corner portion engaged with a rib of said frame member.

7. The fastener clip of claim 6 wherein said fingers include an inner portion and an outer portion sloping upwardly of said base surface toward said free outer end portion.

8. The fastener clip of claim 6 wherein said pair of fingers are formed on opposite edges of said body intermediate said arms to extend toward opposite ribs of said frame member.

9. The fastener clip of claim 7 or 8 wherein said fingers include an inner portion with an upsloping segment and a downsloping segment relative to said base surface, said downsloping segment being adjacent to said outer portion.

10. The fastener clip of claim 6 including a second pair of fingers extending outwardly of said body in opposite directions toward said ribs of said frame member, said second fingers spaced adjacent said axis and the other pair of fingers.

11. The fastener clip of claim 10 wherein said second fingers are wider than said other fingers and are adapted to hold an inner edge portion of a glazing strip along said base surface upon insertion of said inner edge portion into slots formed by said second fingers in order to resist wind loads applied against a glazing panel supported on said frame.

12. The fastener clip of claim 11 wherein the other fingers of said pair are positioned outwardly of said second fingers to resiliently bias said inner edge portion of said glazing strip toward said base surface.

13. The fastener clip of claim 12 wherein said second fingers include an inner portion extending generally parallel of said base surface and outwardly toward said rib and a free outer end portion sloping upwardly of said base surface.

14. The fastener clip of claim 1 including a plurality of stops having stop surfaces spaced from said free outer end portions of said wedging arms and adapted to engage said ribs upon rotation of said fastener body into said second holding position for limiting further rotation thereof.

15. The fastener clip of claim 14 wherein said stops are integral with said body and extend outwardly from said central portion thereof and wherein said stop surfaces are aligned in parallel on opposite sides in alignment with rib engaging outer edges of said wedging arms.

16. A glazed door in combination with at least one fastener clip as defined in claim 1 including:

at least one of said glazing panels;

at least one of said frame members with at least one of said fastener clips mounted on said web of said frame member in said second engaged position, and a pair of said glazing strips, each including a base wedged between said fingers of said fastener clip and a rib of said frame member and having an upstanding leg with an edge portion adjacent a face of said glazing panel.

17. The door combination of claim 16 including a sealing strip of flexible material between said upstanding leg of each glazing strip and an adjacent face of said glazing panel.

18. The door combination of claim 16 wherein said fingers extend toward said opposite ribs of said frame member, and each of said glazing strips includes a base positioned between one of said fingers and a rib of said frame member.

19. The door combination of claim 17 wherein said glazing strips are formed of metal and said sealing strips are formed of resilient plastic material.

20. The door combination of claim 17 wherein each of said glazing strips and an adjacent sealing strip is formed with rib and groove means extending longitudinally thereof for interlocking the glazing and sealing strips together to seal between said glazing panel face and said frame member.

21. The fastener clip of claim 1 wherein said slot means comprises an elongated slot intersecting said axis for receiving a tool for rotating said body to wedge said wedging arms against said ribs.

22. The door combination of claim 16 wherein each of said glazing strips is snapped into wedged engagement with said base thereof between one of said fingers and a rib of said frame member.

23. The door combination of claim 22 wherein said base of said sealing strips overlie said wedging arms engaged with said ribs.

* * * * *